United States Patent [19]

Stolhand

[11] Patent Number: 4,989,268

[45] Date of Patent: Feb. 5, 1991

[54] PRIVACY SHIELD FOR NURSING MOTHERS

[76] Inventor: Andria J. Stolhand, 213 C Amherst Ct., Bloomingdale, Ill. 60108

[21] Appl. No.: 500,700

[22] Filed: Mar. 28, 1990

[51] Int. Cl.[5] ..... A41D 1/20; A41D 1/22

[52] U.S. Cl. ..... 2/104; 2/52; 2/49 A; 224/265

[58] Field of Search ..... 2/46, 48, 49 R, 49 A, 2/50, 51, 52, 104, 306, 305; 224/201, 265, 266

[56] References Cited

U.S. PATENT DOCUMENTS

| | | | |
|---|---|---|---|
| 2,685,757 | 8/1954 | Mirigian | 224/270 X |
| 3,009,613 | 11/1961 | Noland | 224/270 X |
| 4,106,122 | 8/1978 | Dodd . | |
| 4,384,371 | 5/1983 | Sonne . | |
| 4,468,816 | 9/1984 | Kaufer | 2/104 |
| 4,528,699 | 7/1985 | Hughes | 2/104 |
| 4,566,136 | 1/1986 | Echols | 2/104 |
| 4,631,754 | 12/1986 | Ryan . | |
| 4,651,349 | 3/1987 | Heiler . | |
| 4,712,251 | 12/1987 | Cobble . | |
| 4,797,953 | 1/1989 | Dameron | 2/104 |
| 4,799,610 | 1/1989 | Hsieh | 224/201 X |

*Primary Examiner*—Werner H. Schroeder
*Assistant Examiner*—Jeanette E. Chapman
*Attorney, Agent, or Firm*—McAndrews, Held & Malloy, Ltd.

[57] ABSTRACT

A nursing privacy shield for concealing a mother's breast region while nursing her child in public. This nursing privacy shield includes a hooklike member with a first curved portion that fits over the mother's shoulder and a second elongated portion that extends downward over the mother's upper chest area. The shield also has a drape for concealing the mother's upper front chest area and a frame for supporting the drape in front of the nursing mother's upper front chest area so that the nursing baby's head may be disposed between the drape and the nursing mother's chest area. The second elongated portion of the hooklike member is pivotally attached to the frame so that they may be moved relative to each other.

3 Claims, 1 Drawing Sheet

PRIVACY SHIELD FOR NURSING MOTHERS

BACKGROUND OF THE INVENTION

The present invention relates to apparatus to facilitate a mother's nursing of her baby. More particularly, the present invention relates to a privacy shield for use by a nursing mother to cover or screen the mother's chest area from the view of those nearby, as when the mother must nurse her baby in a public place.

There has been a long-standing problem for nursing mothers who have or want to nurse their babies in public places and are embarrassed to perform this private activity under such uncomfortable circumstances. Complicating this lack of privacy, there is also a practical problem of assuring that there will be sufficient air flow to the baby, as well as the necessary eye contact between the mother and baby during nursing.

In the past others have suggested numerous devices or clothing for covering or screening the mother's chest area while she is nursing her baby. For instance, the obvious choice might just be throwing a blanket or comforter over the mother and baby. Others have recognized the potential problems with this choice. U.S. Pat. No. 4,106,122 (Dodd) discloses an apron-like garment which fits around the mother's neck and which has flaps with concealed slits which overlay the mother's chest. The baby can nurse underneath the middle portion of this garment while the flaps conceal the mother's breast region. However, this garment blocks the free flow of air to the baby and the mother has difficulty seeing the baby during the nursing.

U.S. Pat. No. 4,384,371 (Sonne) discloses a nursing baby bonnet which has an attachable wide brim. When the baby wishes to nurse, the mother attaches the brim to the baby's bonnet. When the mother then removes her clothes so as to expose her breast region, the brim of the hat conceals this region while the baby is nursing. The disadvantage of this bonnet is the probability that the hat may fall off while the baby nurses. There is also the obvious discomfort to the baby while he or she attempts to nurse while wearing this relatively enormous bonnet.

U.S. Pat. No. 4,631,754 (Ryan) discloses a nursing scarf that consists of a trapezoidal piece of cloth worn around the nursing mother's neck and over her regular clothing. This scarf is intended to shield the mother's breast area and includes pleats which create an opening at the scarf's upper edge to allow eye contact between mother and infant. However, the scarf is not adequately secured to the mother so that if the baby should inadvertently jostle it, it could fall away and expose the mother's breast area to public view. Free flow of air to the baby is also difficult, notwithstanding the pleats.

U.S. Pat. No. 4,651,349 (Heilor) discloses a halter-type garment consisting of three sections: (1) an upper portion which fits around the mother's neck and under which the baby can nurse; (2) a middle region, which is actually a sling in which the mother places her arm while holding the baby; and (3) a bottom padded section, which is designed primarily to cushion the baby while nursing. The upper section also has a screen portion for providing air to the baby and for allowing the mother to view the baby while nursing. This garment may be adjusted for burping by placing the baby on the exterior surface and over an attachable "burping cloth." The disadvantage of this garment, in addition to insufficient air to the baby, is the mother's discomfort from the constricted sleeve section into which she must place her arm.

U.S. Pat. No. 4,712,251 (Cobble) discloses a nursing device with a pad comprised of a section covering approximately one-half of the mother's chest region, and extending over her shoulder with a similar section over her back. A blanket detachably fastens to the section over the mother's chest so that the mother can nurse the baby under the blanket. The blanket also can be partially opened by means of separate fasteners or straps, so the mother can view the baby underneath the blanket. The major disadvantage of the Cobble device is minimal air flow to the baby.

None of the foregoing patented garments and devices allow maximum air circulation to the baby. These garments and devices also do not enable the mother to easily view the child while he or she is nursing, or provide maximum comfort to the mother, with positive, secure protection of the mother's privacy.

SUMMARY OF THE INVENTION

To solve this long-standing problem in the art, my present invention provides an improved privacy shield for concealing the baby while nursing. This shield allows unlimited visual contact between the mother and baby, while permitting a sufficient flow of air to reach the baby during nursing. In addition, my improved shield is easily cleaned and can be conveniently folded for traveling.

Accordingly, an object of my present invention is to provide an improved nursing privacy shield that facilitates the breast feeding of a baby in public. A related object of my invention is to provide a nursing shield which facilitates a free flow of air to the baby while nursing.

Another object of my present invention is to provide an improved nursing privacy shield that permits maximum eye contact between the mother and baby during nursing.

Yet another object of my present invention is to provide an improved nursing privacy shield comprising a hooklike member, a privacy drape and a frame that supports the drape. The hooklike member has a first curved portion which flexibly fits over a nursing mother's shoulder, and a second elongated portion extending downward over the mother's upper front chest area. The frame is comprised of a straight segment and a curved segment that has a substantially semi-circular configuration. The second elongated portion of the hooklike member is pivotally attached to the frame so that the curved portion of the frame projects and is spaced horizontally from the mother's chest. The drape is attached to the curved segment of the frame and extends downwardly from the frame. When the first end of the hooklike member is placed over a nursing mother's shoulder, the straight segment of the frame rests against the upper part of the mother's chest, above the breast region and below the neck region. The baby may then be held to the mother's breast and under the drape whose upper end is held away from the mother's chest by the curved segment of the frame. Thus, the baby may nurse beneath and within the opening formed the curve segment while the mother's chest region is concealed from view by the drape. Simultaneously, the mother can easily see her baby nursing by looking down between the straight and curved segments of the frame.

A further object of my invention is to provide a machine washable carrying case so that my improved nursing privacy shield can easily be stored for carrying while the mother and baby are traveling. A related object of my invention is to provide a nursing privacy shield which a mother will use often because it is both comfortable and convenient.

These and still other objects and advantages of my invention will become apparent from the following description of the preferred embodiment of my present invention.

BRIEF DESCRIPTION OF THE DRAWINGS

My invention may be better understood by reference to the drawings accompanying this specification in which.

DETAILED DESCRIPTION OF THE PREFERRED EMBODIMENT OF THE INVENTION

Figure 1:
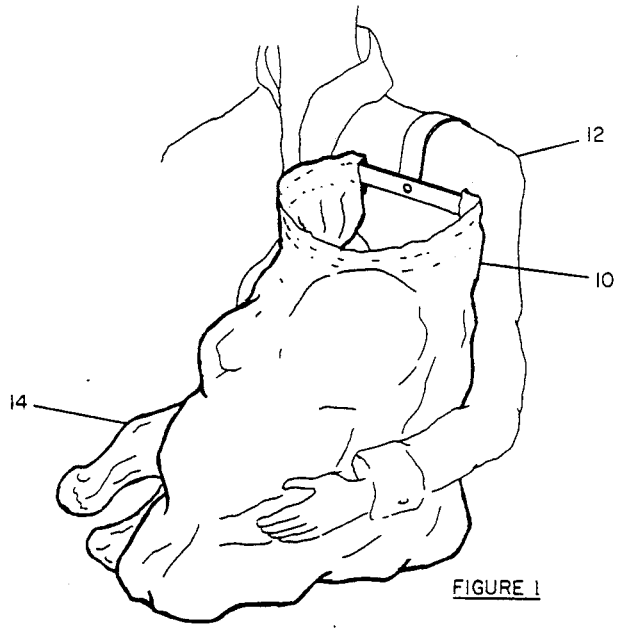
FIG. 1 is a perspective view of my nursing privacy shield shown being used by a nursing mother.
Figure 2:
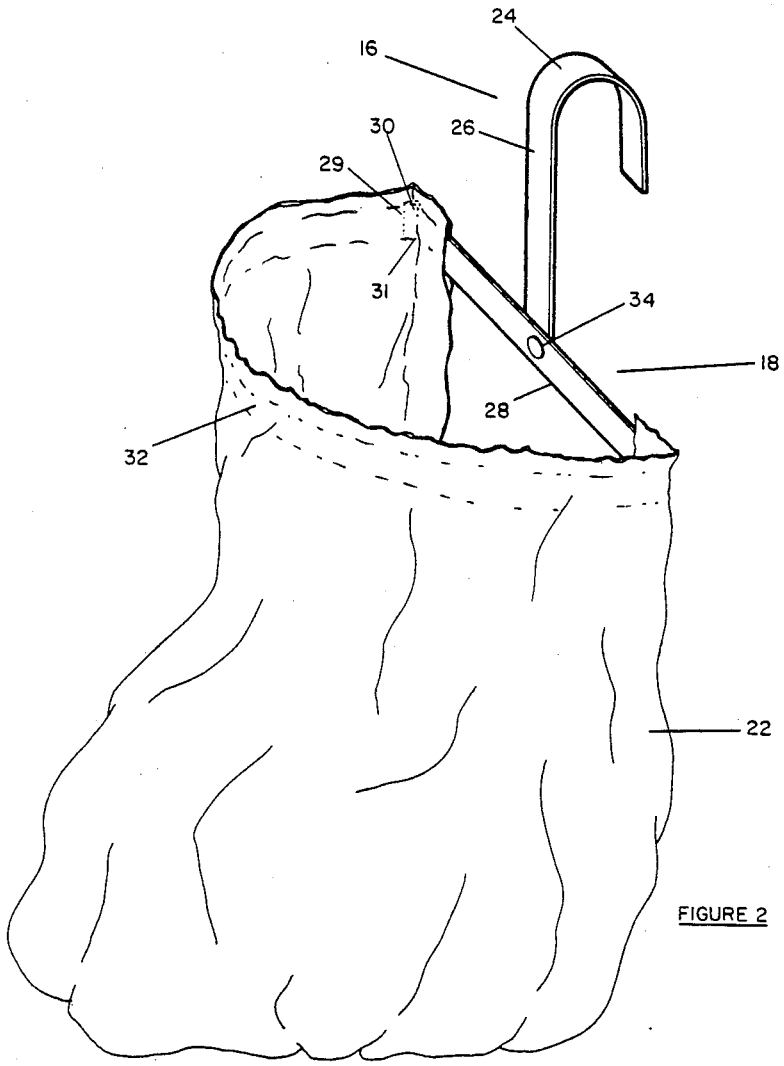
FIG. 2 is a perspective view of the nursing shield of FIG. 1.

As shown in FIG. 1, the improved nursing privacy shield of the present invention, shown generally at 10, permits a nursing mother 12 to nurse her baby 14 safely and in comfort while shielding her breast region from public view. As best illustrated in FIG. 2, this shield 10 includes a hooklike member 16, a frame 18, and a drape 22.

The hooklike member 16 includes a first curved portion 24 and a second elongated portion 26. It is made from a relatively flexible plastic strip or band approximately one-half inch in width and approximately one-eighth inch in thickness. Preferably the plastic band is made from polyurethane or other flexible plastic.

The first curved portion 24 is adapted and designed to fit over a shoulder (the left shoulder as shown in FIG. 1) of the nursing mother 12 so that its distal end is adjacent to the mother's shoulder blade area. This first curved portion 24 has a radius of curvature of approximately two and three quarters inches at its midpoint. This curvature will vary depending on the weight of the mother. The second elongated portion 26 extends down the front of the mother's chest to a point below the neck region and above the breast region. It extends approximately five inches in length from the curved portion 24.

The frame 18 comprises a straight segment 28 approximately six inches in length and an integral curved segment 32. It is made from a plastic strip or band substantially similar to the strip used for the member 16 but is less rigid, and has a thickness of only one-sixteenth inch. The outer ends (that is, the ends adjacent to the mother's shoulder) of the straight segment 28 and the curved segment 32 are secured together, as for example, by a conventional rivet, not shown. Alternatively, the outer ends can be integrally attached.

The straight segment 28 has a crimp 29 or outwardly facing angle formed in its other free end 30. The other free end 31 of curved segment 32 may fit into and be held by or hooked by this crimp 29 so that the curved segment forms a closed semicircular configuration.

The lower distal end of the second elongated portion 26 of the hooklike member 16 is pivotally attached to the frame 18 at approximately the center of straight segment 28 by a conventional rivet 34. When the curved segment 32 is thus hooked and when straight segment 28 is positioned flush against the mother's chest, the curved segment 32 is spaced from her chest, with the midpoint of the curved segment being at least two inches or more from her chest.

The drape 22 is made of a light-weight flexible, opaque fabric material, that is, a cloth such as a polyester blend, and is attached to the frame. More particularly, the upper end of the drape is looped over and sewn to form a pocket around the curved segment 32, the material comprising the drape gathered in pleats. It may be extended partially around and over the ends of the straight segment 28 when the curved segment is hooked to the crimp 29.

As best seen in FIG. 1, the drape 22 extends continuously downward from the frame to cover the mother's chest and torso. The drape may be compressed to cover a shorter distance along the straight segment 28, or can be expanded to cover a longer distance along the straight segment. The width of the material used for the drape 22 is approximately twenty-nine inches along its bottom border.

As illustrated in FIG. 1, the curved segment 32 of the frame 18 defines a wide opening down into which the mother can look to see the head of her nursing baby. The length of the drape 22 is a matter of personal taste, but generally the drape should extend downward at least approximately twenty-four inches.

As shown in FIGS. 1 and 2, when using the shield 10 to discretely nurse a baby, the hooklike member 24 is fitted over the nursing mother's shoulder. The straight segment is positioned against the mother's chest, above the mother's breast, and the baby is then held under the drape, within the frame 18. The drape 22 is adjusted along the frame to shield the baby's head and to cover the mother's exposed chest region from view.

Also as shown in FIG. 1, the mother need only look downward into the closed configuration of the frame, that is, between the curved and straight segment to view her baby while nursing. In addition, there is a free flow of air to the baby because of the relatively wide upper opening defined between the curved and straight segments of the frame.

This nursing shield of my invention may be used by mothers of any size and with babies or nursing children of any age or size. It is also useful to a non-nursing mother if she wishes to make the baby's surroundings more peaceful and quiet.

The shield 10 may be folded into a matching cloth bag, which is not shown and which can be used to carry other items for a baby's care when the child is away from home. To fold the shield 10, the mother merely folds the drape 22 in half, and then neatly wraps it around the frame 18. The drape as well as the cloth bag can be made from a material that is entirely machine washable and dryable.

The above is a description of the best mode of my invention. However, those skilled in the art may envision other possible variations within the invention's scope by changing the dimensions and shapes of its various components. For example, they could make the drape of various fabrics. In addition, the frame and hooklike member could be made from a variety of light-weight metals including, but not limited to, aluminum. Similarly, the pivotal attachment of the hooklike member to the frame could be accomplished by other means, such as by the use of a small screw or pin.

Accordingly since my invention may be embodied in the specific forms without departing from the spirit or essential characteristics thereof, the present embodiment is therefore considered to be in all respects an illustrative and not restrictive. The scope of my invention is indicated by the appended claims rather than by the foregoing description, and all changes which come within the meaning and range of equivalency of the claims are therefore intended to be embraced therein.

I claim:

1. A nursing privacy shield for concealing a mother's breast region while nursing her child comprising:

(a) a hooklike member having a first curved portion and a second elongated portion, said first curved portion flexibly fitting over and being supported on a nursing mother's shoulder, and said second elongated portion extending downward over the mother's upper front chest area;

(b) means for concealing the nursing mother's upper front chest area, said concealing means comprising a flexible opaque material;

(c) means for supporting the concealing means in front of the nursing mother's upper front chest area, with the supporting means maintaining the concealing means a preselected distance from the nursing mother's chest area so that the nursing baby's head may be disposed between the concealing means and the nursing mother's chest area and so that the nursing mother may view the baby's head while the baby is nursing; and (d) means for pivotally attaching the second portion of said hooklike member to the supporting means so that the hooklike member and the supporting means may be moved relative to each other.

2. The nursing privacy shield according to claim 1 wherein said supporting means includes a frame made of a strip of a flexible plastic and said hooklike member is made of a strip of a flexible plastic.

3. The nursing privacy shield according to claim 2 wherein said hooklike member is pivotally attached to the frame by a rivet.

* * * * *